US007140333B2

(12) United States Patent
Persson et al.

(10) Patent No.: US 7,140,333 B2
(45) Date of Patent: Nov. 28, 2006

(54) APPARATUS FOR AN INTERNAL COMBUSTION ENGINE

(75) Inventors: Per Persson, Partille (SE); Jan Arnell, Hisings Kärra (SE); Johan Remmelgas, Torslanda (SE)

(73) Assignee: Volvo Lastvagnar AB, Göteborg (SE)

( * ) Notice: Subject to any disclaimer, the term of this patent is extended or adjusted under 35 U.S.C. 154(b) by 0 days.

(21) Appl. No.: 10/605,993

(22) Filed: Nov. 12, 2003

(65) Prior Publication Data

US 2004/0168660 A1 Sep. 2, 2004

Related U.S. Application Data

(60) Provisional application No. 60/425,257, filed on Nov. 12, 2002.

(51) Int. Cl.
*F01L 1/34* (2006.01)

(52) U.S. Cl. ..... 123/90.16; 123/90.15; 123/90.39; 123/90.12

(58) Field of Classification Search ..... 123/90.12, 123/90.15–90.18, 90.39–90.47; 74/53–55, 74/569

See application file for complete search history.

(56) References Cited

U.S. PATENT DOCUMENTS

| | | | | |
|---|---|---|---|---|
| 5,273,013 | A | 12/1993 | Kubis et al. | |
| 5,609,133 | A | 3/1997 | Hakansson | |
| RE35,662 | E * | 11/1997 | Murata et al. | 123/90.16 |
| 5,682,848 | A * | 11/1997 | Hampton et al. | 123/90.16 |
| 6,032,643 | A | 3/2000 | Hosaka et al. | |
| 6,067,946 | A * | 5/2000 | Bunker et al. | 123/90.12 |
| 6,186,101 | B1 * | 2/2001 | Kreuter | 123/90.15 |
| 6,223,846 | B1 * | 5/2001 | Schechter | 180/165 |
| 6,386,160 | B1 * | 5/2002 | Meneely et al. | 123/90.16 |
| 2004/0055547 | A1 * | 3/2004 | Diehl et al. | 123/90.12 |

FOREIGN PATENT DOCUMENTS

| | | |
|---|---|---|
| DE | 4331898 A1 | 3/1994 |
| SU | 1158772 A | 5/1985 |

* cited by examiner

*Primary Examiner*—Thomas Denion
*Assistant Examiner*—Zelalem Eshete
(74) *Attorney, Agent, or Firm*—Novak Druce & Quigg, LLP

(57) ABSTRACT

Method and apparatus for providing an internal combustion engine which for each cylinder, with the associated piston, has at least one inlet valve and at least one exhaust valve (10) for controlling the connection between the combustion chamber in the cylinder and an intake system and an exhaust system, respectively. A rotatable camshaft (18) with a cam (22) is designed to interact with a first cam follower (17) and a second cam follower (20) in order to switch between two different operating modes. The cam followers are mounted on a pivotal rocker arm (13), the second cam follower (20) being hydraulically adjustable between two positions by means of a piston (21) located in a hydraulic cylinder. The hydraulic cylinder is connected to a hydraulic fluid source via a hydraulic fluid duct and the piston can be moved from one position to the other by the action of a quantity of hydraulic fluid delivered to the hydraulic cylinder.

5 Claims, 2 Drawing Sheets

APPARATUS FOR AN INTERNAL COMBUSTION ENGINE

CROSS REFERENCE TO RELATED APPLICATIONS

The present application claims the benefit of U.S. Provisional Application No. 60/425,257 filed 12 Nov. 2002, the disclosure of which is expressly incorporated herein by reference in its entirety.

BACKGROUND OF INVENTION

1. Technical Field

The present invention relates to an apparatus for an internal combustion engine and which for each cylinder, with the associated piston, has at least one inlet valve and at least one exhaust valve for controlling the connection between the combustion chamber in the cylinder and an intake system and an exhaust system, respectively. A rotatable camshaft, with a cam, is utilized and which is designed (configured) to interact with a first cam follower and a second cam follower in order to switch between two different operating modes.

2. Background

There are numerous examples of the need to be able to adjust the valve lift in inlet and/or exhaust valves of an internal combustion engine. Such examples include the activation/deactivation of a compression brake system on an internal combustion engine for heavy road vehicles; that is, providing additional valve movement that is only operative during engine braking. Another example includes the generation of valve lift curves of differing width of the Miller-cycle type, for example, for use at different operating points in the engine working range. Another example is for utilization in the complete deactivation of valve movement when isolating certain cylinders at partial load and the like. Still a further example includes utilization to institute internal exhaust gas recirculation via the exhaust valve or via the inlet valve.

When the facility is required for fixing a rocker arm part in relation to another part, for example, an actuator is required that can overcome the forces occurring between the various parts without any impact occurring when the movement of the rocker arm parts in relation to one another approaches the limit positions. The movement of the rocker arm is controlled by a cam that defines the movements and accelerations that constituent parts must perform in order to achieve the required lifting movement, thus giving rise to forces and torque in the mechanism. These accelerations must be multiplied by the masses and mass moment of inertia, and any spring forces acting on the mechanism must be added in order to obtain the total forces in the system.

It is desirable that apparatuses for producing additional openings of valves should not extend significantly in a longitudinal direction in the space available for the engine valve mechanism. For example, the high compression ratios that occur in modern diesel engines mean that the valve mechanism must be designed for very high contact pressures. Furthermore, this type of engine may be fitted with some form of compression brake system, which requires space for actuating members. Consequently no apparatuses for switching between two valve operating modes should encroach on the existing compression brake system. It is also desirable to be able to perform this switch from one mode to another in a simple way.

SUMMARY OF INVENTION

An object of the invention therefore is to provide an apparatus which permits switching from one valve operating mode to another in an internal combustion engine, within the functional constraints described above. This object is achieved by providing an apparatus for an internal combustion engine, and which for each cylinder and associated piston, has at least one inlet valve and at least one exhaust valve for controlling connection between the combustion chamber in the cylinder and an intake system and an exhaust system, respectively. A rotatable camshaft (18) is provided and which has a cam designed to interact with a first cam follower and a second cam follower in order to switch between two different operating modes.

BRIEF DESCRIPTION OF DRAWINGS

The invention will be described in more detail below, with reference to examples of embodiments shown in the accompanying drawings in which.

DETAILED DESCRIPTION

Figure 1:
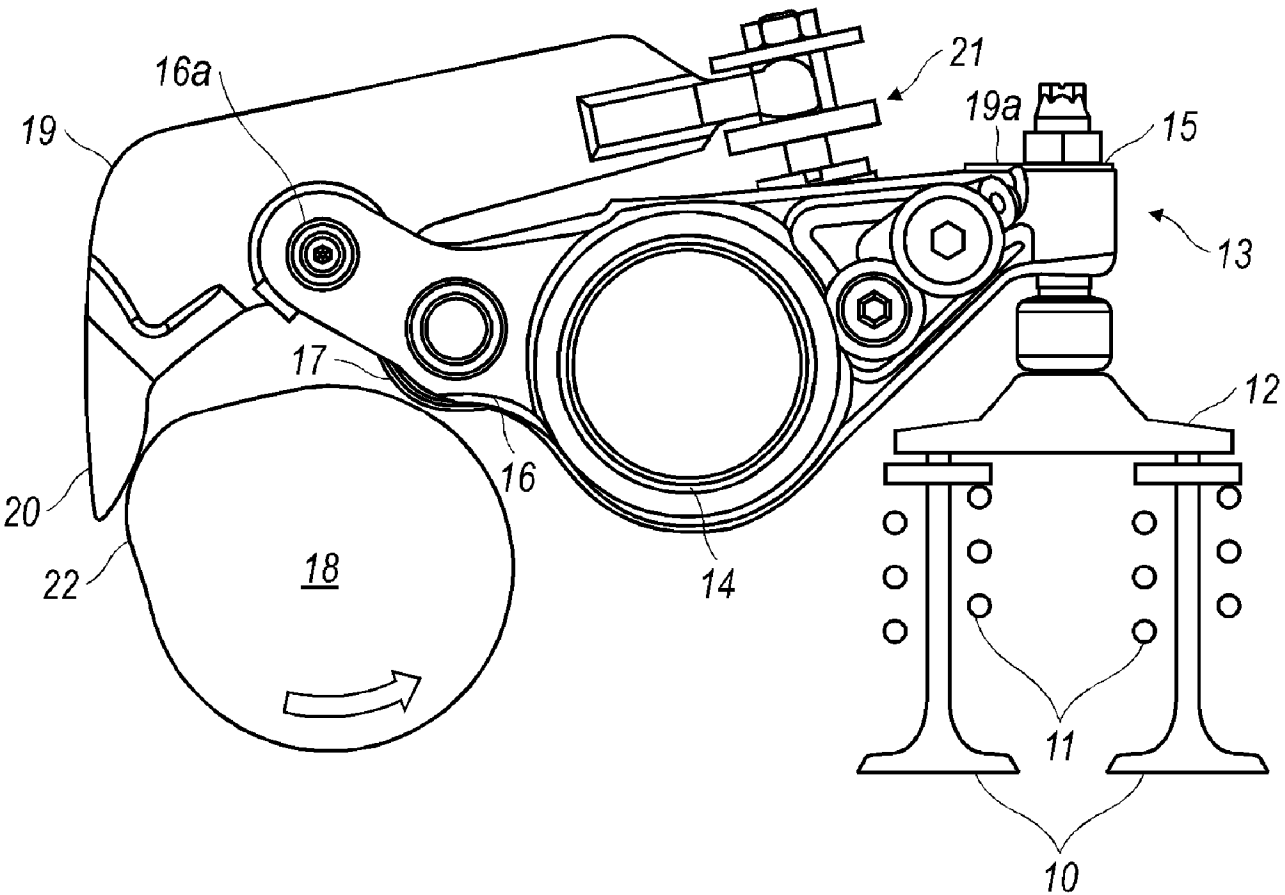
FIG. 1 is a representation of a valve mechanism shown in partial cutaway and embodied with a capability for switching between two operating modes according to the teachings of the present invention.

The valve mechanism shown in FIG. 1 is located in a cylinder head and comprises (includes, but is not limited to) double valves 10 with valve springs 11 and a common yoke 12. The yoke is acted upon by a rocker arm 13, which is pivotally supported on a rocker arm shaft 14. The rocker arm 13 has a valve pressure arm 15 on one side of the shaft 14 and a cam follower arm 16 on the other side. The cam follower arm is provided with a first cam follower in the form of a rocker arm roller 17 that normally interacts with a camshaft 18. The cam follower arm 16 is furthermore provided with a secondary arm 19, which is pivotally supported at the outer end 16*a* of the arm and is provided with a second cam follower in the form of a finger 20.

The secondary arm 19 is adjustable between an inoperative position and an operative position by means of a hydraulic piston 21 that is located in the rocker arm, and which will be described in more detail below with reference to FIG. 2. The hydraulic piston 21 is coupled, essentially free of play, to the secondary arm 19 by way of a fork 19*a*.

In an inoperative position, the rocker arm 13 is acted upon by a disk cam 22 of the camshaft 18 solely via the rocker arm roller 17. In the operative position that is shown in FIG. 1, the rocker arm 13 is acted upon by the disk cam 22 of the camshaft also via the finger 20. The geometry of the secondary arm 19 is adapted so that in the operative position the rocker arm is actuated by the disk cam 22 at a required phase angle (in the illustrated case, approximately 80–110 degrees) later in the direction of rotation of the camshaft 18.

In order to produce two separate gentle lifting movements by means of one and the same disk cam 22, this may have a first rising ramp for interaction with the pressure roller 17 during the first opening phase of the valve, and a second rising ramp for interaction with the pressure roller 17 and the finger 20 during both opening phases of the valve 10. In addition, the cam may have a first falling ramp and a second falling ramp largely corresponding to the rising ramps.

Figure 2:
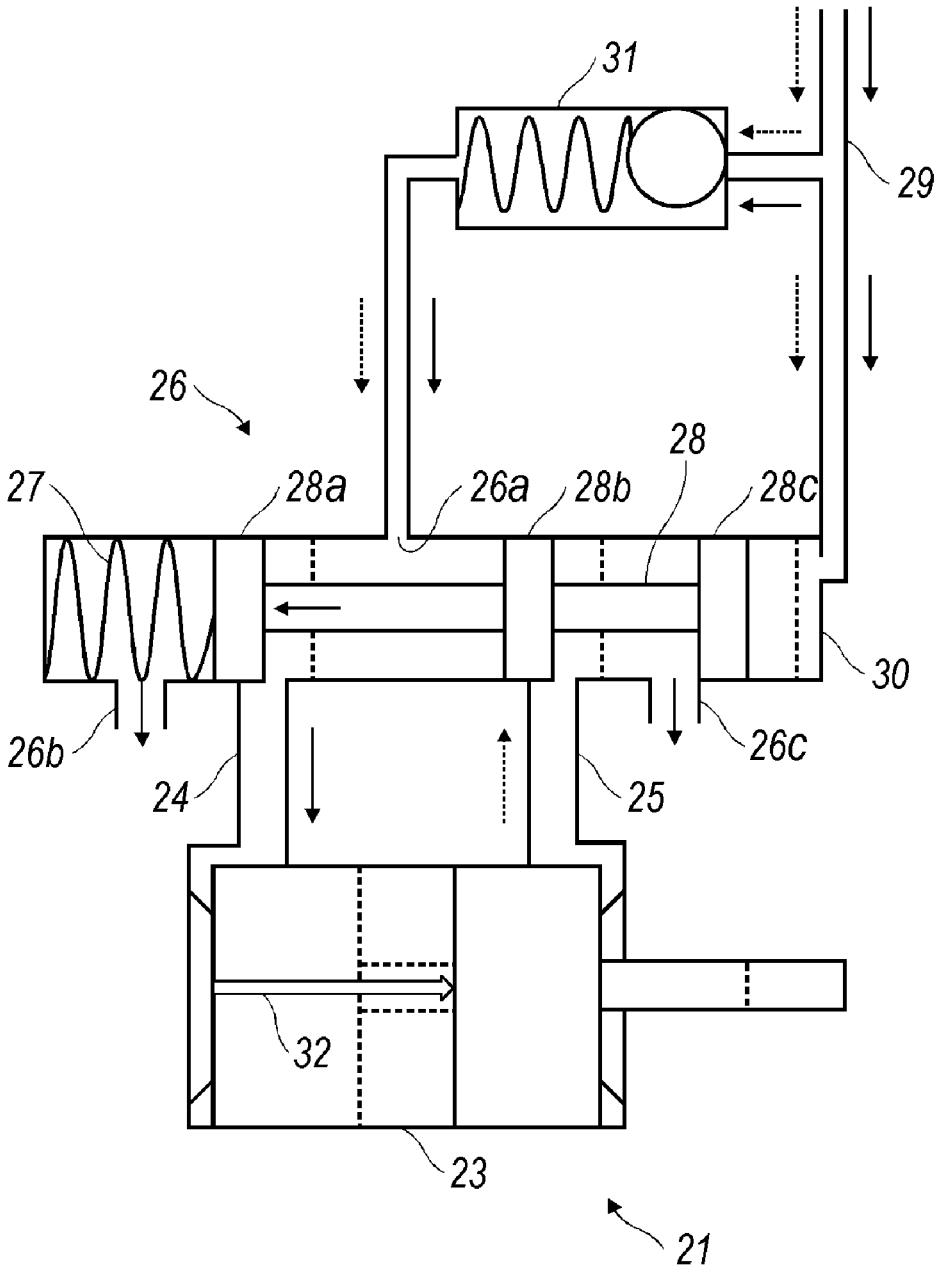
FIG. 2 is a schematic diagram of a hydraulic circuit useable for actuating a valve mechanism configured according to FIG. 1.

Control members of the hydraulic piston 21 are shown in FIG. 2, and from which it can be seen that the piston cylinder 23 is double-acting with inlet and outlet ports 24 and 25 connected to a control valve 26. The cylinder 23 is fitted with a pilot piston 28 that is loaded towards a limit position (indicated by dashed lines in FIG. 2) by means of a helical coil spring 27 and which has three valve heads 28*a*, 28*b* and 28*c*. The control valve 26 is also provided with an inlet port 26*a* and two outlet ports 26*b* and 26*c*. An adjustable pilot pressure (1–4 bar) is supplied via a feed line 29 for hydraulic fluid such as the lubricating oil of the internal combustion engine, which is connected to the control valve 26 on the opposite side 30 to the spring 27. The feed pressure to the piston cylinder 23 is supplied by the line 29 via a spring-loaded non-return valve 31 (one-way valve) and the inlet port 26*a* of the control valve 26.

In the position of use illustrated by solid lines in FIG. 2, a higher pilot pressure has been applied to the control valve 26 via the line 29 in such a way that the control force of the spring 27 has been overcome, with the result that the pilot piston 28 has been shifted to the left in FIG. 2. The piston head 28*a* has thereby opened a connection between the port 24 of the piston cylinder and the inlet port 26*a* of the control valve. Hydraulic fluid can now be fed from the line 29 to the piston cylinder via the non-return valve 31. At the same time, the outlet port 26*c* of the control valve has a connection to the port 25 of the piston cylinder for draining hydraulic fluid from the other side of the piston. If an external force is applied to the hydraulic piston 21 in the opposite direction to the direction of the movement (see the arrow 32 in FIG. 2), this is incapable of moving back since the non-return valve blocks the return flow from the piston cylinder. The force is capable of generating an internal pressure in the piston cylinder, the control valve and the non-return valve that can amount to several hundred bars, without any return movement of the piston 21.

In the position of use illustrated by dashed lines in FIG. 2, a lower pilot pressure has been applied to the control valve 26, via the line 29, and the control force of the spring 27 is forcing the pilot piston 28 to shift to the right in FIG. 2. The piston head 28*b* thereby opens a connection between the port 25 of the piston cylinder and the control valve inlet port 26*a*. Hydraulic fluid can then be fed from the line 29 to the right-hand side of the piston in FIG. 2 via the non-return valve 31. At the same time, the outlet port 26*b* of the control valve has a connection to the piston cylinder port 24 for draining hydraulic fluid from the left-hand side of the piston in FIG. 2. The hydraulic piston 21 can now move from right to left in FIG. 2 from the position drawn in "solid line" to that drawn in "dashed line." If an external force is applied to the hydraulic piston 21, it is incapable of moving back since the non-return valve blocks the return flow from the piston cylinder. The force may generate an internal pressure in the piston cylinder, the control valve and the non-return valve that can amount to several hundred bars, without any movement of the piston 21.

The method described above for switching from one operating mode to another functions in a valve mechanism, since the accelerations and hence the forces change sign one or more times during a camshaft revolution. In other words, at the time increment when the force is positive, the hydraulic piston follows and oil flows into its chamber, whereas at the time increment when the acceleration is negative, the non-return valve blocks the return flow of oil and the oil pressure can reach high levels. In this way, it is therefore possible to move two rocker arm parts relative to one another to a mechanically defined stop by means of a small hydraulic piston and a low hydraulic pressure, despite the fact that the forces involved are large forces.

The invention must not be regarded as being restricted to the examples of embodiments described above; a number of further variants and modifications are feasible within the scope of the following patent claims. For example, the second cam follower 20 may be actuated in some other way than via a pivoted arm 19, for example by translational movement.

The invention claimed is:

1. Apparatus for controlling the operation of a valve of a combustion chamber of an internal combustion engine, comprising:

a pivotable rocker arm coupled to said valve, said rocker arm including a first cam follower interacting with a lobe of a rotating cam at a first rotational position of said cam to cause said rocker arm to pivot and thereby open said valve;

a second cam follower selectively interacting with said lobe of said rotating cam at a second rotational position of said cam to cause said rocker arm to pivot and thereby open said valve, said second cam follower being adjustably mounted to said rocker arm and movable between two operational positions by selective action of a hydraulic piston, wherein said second cam follower interacts with said lobe at a first operational position thereof with respect to said rocker arm, and has no interaction with said lobe at a second operational position thereof with respect to said rocker arm.

2. The apparatus as recited in claim 1, further comprising:

a control valve and a non-return valve being connected between a hydraulic fluid source and a hydraulic cylinder paired with said hydraulic piston.

3. The apparatus as recited in claim 2, wherein the control valve is actuatable by switching between two pressure levels in a hydraulic circuit connected to the hydraulic fluid source.

4. The apparatus as recited in claim 2, the hydraulic piston is fitted in a double-acting piston cylinder.

5. The apparatus as recited in claim 4, further comprising:

the control valve in one control position connects the hydraulic fluid source to one side of the hydraulic piston via the non-return valve, and another side of the hydraulic piston is connected to a drainage port for hydraulic fluid, and the non-return valve configured to shut off flow towards the hydraulic fluid source.

* * * * *